US008851326B2

(12) United States Patent
Tramontina et al.

(10) Patent No.: US 8,851,326 B2
(45) Date of Patent: Oct. 7, 2014

(54) FOLDED SHEET DISPENSER WITH OVERFILL PREVENTION DEVICE

(75) Inventors: Paul Francis Tramontina, Harleysville, PA (US); Jonathan Green, Warlingham (GB); Wolfgang Heich, Idar-Oberstein (DE)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 106 days.

(21) Appl. No.: 13/274,957

(22) Filed: Oct. 17, 2011

(65) Prior Publication Data

US 2013/0092701 A1 Apr. 18, 2013

(51) Int. Cl.
*B65D 83/08* (2006.01)

(52) U.S. Cl.
USPC ..... 221/45; 221/44; 221/61; 221/279

(58) Field of Classification Search
USPC ..... 221/33, 45, 61, 62, 154, 199, 281
See application file for complete search history.

(56) References Cited

U.S. PATENT DOCUMENTS

| | | | | |
|---|---|---|---|---|
| 1,784,836 | A * | 12/1930 | Hess | 221/55 |
| 4,329,001 | A | 5/1982 | Filipowicz et al. | |
| 4,938,382 | A * | 7/1990 | Frazier et al. | 221/45 |
| 5,076,466 | A | 12/1991 | Petterson et al. | |
| 5,884,805 | A | 3/1999 | Tramontina | |
| 6,592,002 | B2 * | 7/2003 | Clark et al. | 221/46 |
| 6,920,999 | B2 * | 7/2005 | Taylor et al. | 221/154 |
| 7,374,065 | B2 | 5/2008 | Taylor et al. | |
| 2002/0070228 | A1 | 6/2002 | Moody | |
| 2002/0074340 | A1 | 6/2002 | Phelps | |
| 2003/0080137 | A1 * | 5/2003 | Clark et al. | 221/34 |
| 2003/0201274 | A1 | 10/2003 | Taylor et al. | |
| 2004/0007586 | A1 | 1/2004 | Boone | |
| 2004/0084470 | A1 * | 5/2004 | Taylor et al. | 221/52 |
| 2004/0084471 | A1 * | 5/2004 | Taylor et al. | 221/61 |

FOREIGN PATENT DOCUMENTS

WO WO 97/09918 A1 3/1997

* cited by examiner

*Primary Examiner* — Gene Crawford
*Assistant Examiner* — Kelvin L Randall, Jr.
(74) *Attorney, Agent, or Firm* — Nancy M. Klembus; Ralph H. Dean, Jr.

(57) ABSTRACT

The present invention provides a dispenser for folded sheets having an overfill prevention device, which effectively prevents the dispenser from being overfilled with folded sheet material. The result of the present invention is that a maintainer of the dispenser will have a difficult time overfilling the dispenser.

16 Claims, 7 Drawing Sheets

FOLDED SHEET DISPENSER WITH OVERFILL PREVENTION DEVICE

FIELD OF THE INVENTION

The present invention generally relates to a folded sheet dispenser, in particular to a folded sheet dispenser with an overfill prevention device.

BACKGROUND OF THE INVENTION

Dispensers of sheet products in roll form are simple and reliable because the rolls are easy to load and the dispensers are very difficult to overload or overstuff. However, products in roll form present some dispensing problems. A single roll dispenser with a nearly depleted roll must be monitored carefully by maintenance personnel to avoid running out at an inconvenient moment. Changing a partially depleted roll results in wasted product. Moreover, some single roll dispensers are designed so a roll cannot be removed until it is depleted and only a core is left.

Dispensers for dispensing stacked folded sheets of paper towels and the like are well known in the art. Single sheet dispensers are generally desirable because they can be refilled when only partially depleted, as compared to roll product dispensers wherein changing a partially depleted roll may result in significant wasted product. Stacked single sheet dispensers are also desirable because they tend to be simple devices that are not subject to jamming or failure.

A disadvantage of folded stacked sheet dispensers is that they are susceptible to attempts at being overfilled or "stuffed." Overfilling the dispenser can compress the stack of sheets and make it very difficult to remove a sheet from the dispenser. For example, the pressure against the stack may prevent a free tab or end of the sheet from becoming accessible for a user to grasp in order to withdraw the sheet. In an overfilled condition, the stack of sheets may be wedged in the dispenser so firmly that the portion of the sheet grasped by the user simply tears instead of dispensing the sheet. Friction against the dispensing opening may be increased by overfilling the dispenser making dispensing unreliable and problematic.

There is still a need in the art for improvements in stacked folded sheet dispensers for preventing overfill conditions. The present invention relates to such an improved dispenser.

SUMMARY OF THE INVENTION

Generally stated, the present invention provides a folded sheet dispenser with a simple, but effective overfill prevention device.

In one embodiment of the present invention, the present invention provides a folded sheet dispenser having a. a mounting frame adapted to hold a stack of folded sheets, the mounting frame including a back panel, a bottom portion and a top portion;

b. a cover connected to the mounting frame, the cover having an inside surface which faces the mounting frame and an exterior surface forming the front of the dispenser, the cover having at least one projection extending from the inside surface;

c. a dispensing opening located at or near the bottom portion of the mounting frame;

d. an overfill prevention device located at or near the top portion of the mounting frame, said overfill prevention device comprises i. a bracket having a first section which is pivotally connected to a housing and an opposite second section, said second section being free to rotate in an arc about the pivotally connected first section, the bracket has a filling position and a dispensing position, wherein the bracket is adapted to contact a stack of folded sheets, when the dispenser is filled with a stack of folded sheets;

ii. a locking element which engages the bracket and holds the bracket in the filling position when the cover of the dispenser is open and releases the bracket when the cover of the dispenser is closed; and wherein the projection on the cover engages the locking element as the cover is being closed such that the locking element releases the bracket to allow the bracket to move to the dispensing position.

In a further embodiment of the present invention, the locking element is a plate. The plate has a first end and an opposite second end. In addition, the plate is connected to the mounting frame with a pivot connection at or near the first end of the plate and the opposite second end of the plate is free to move in an arc about the pivot connection. Typically, the second end of the plate engages the bracket, retaining the bracket in the filling position when the cover is open. In one aspect of the present invention, the plate engages the bracket using the force of gravity.

In an additional embodiment of the present invention, the bracket has an upper portion and a lower portion. The lower portion is adapted to contact the stack of folded sheets in the dispenser and the upper portion is adapted to be engaged with the locking element.

In another embodiment of the present invention, the upper portion of the bracket further has at least one slot. This slot is positioned at or near where the locking element engages the bracket. The slot is configured to allow the protrusion on the cover to engage the lock element without engaging the bracket.

In yet another embodiment of the present invention, the overfill prevention device further has a housing. This housing comprises at least one opening, such that the opening is positioned in the housing to allow the projection on the cover to contact the locking element.

By providing the folded towel dispenser of the present invention, drawbacks of the conventional overfill prevention devices can be overcome

DEFINITIONS

Figure 1:
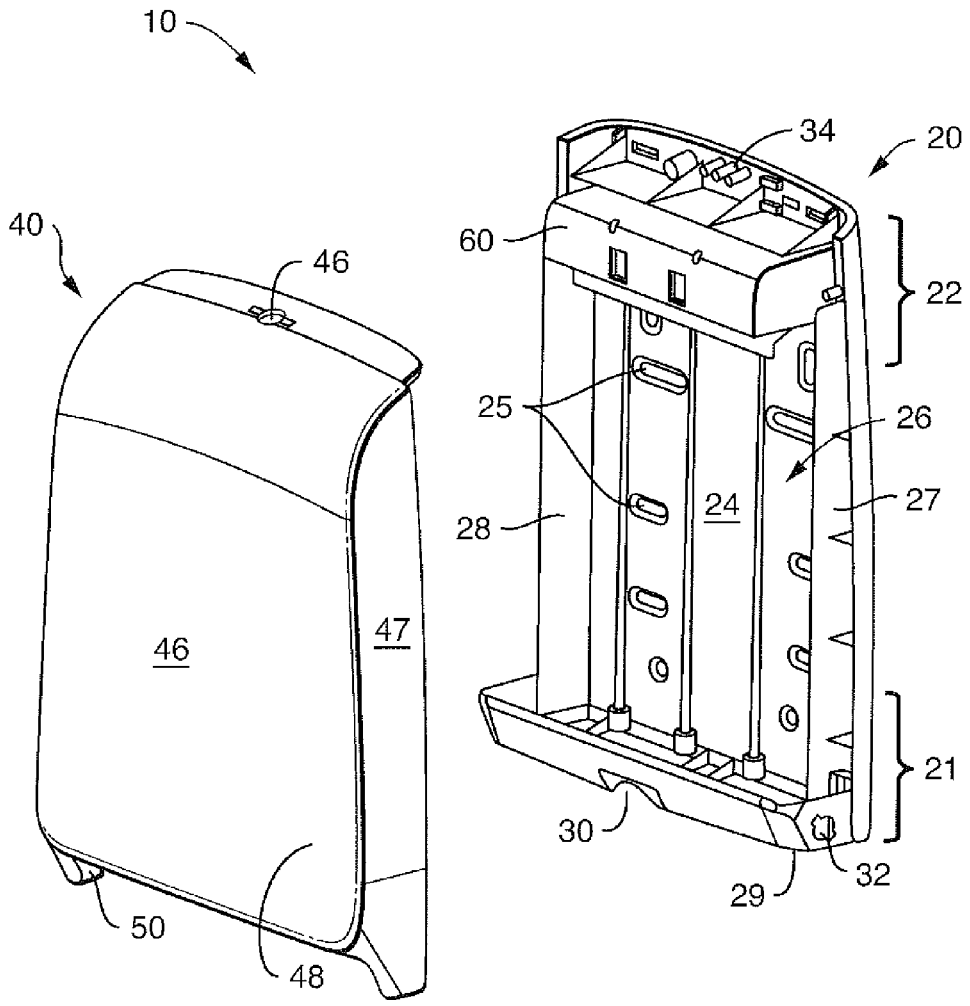
FIG. 1 shows a exploded perspective view of the dispenser within the scope present invention.
Figure 2:
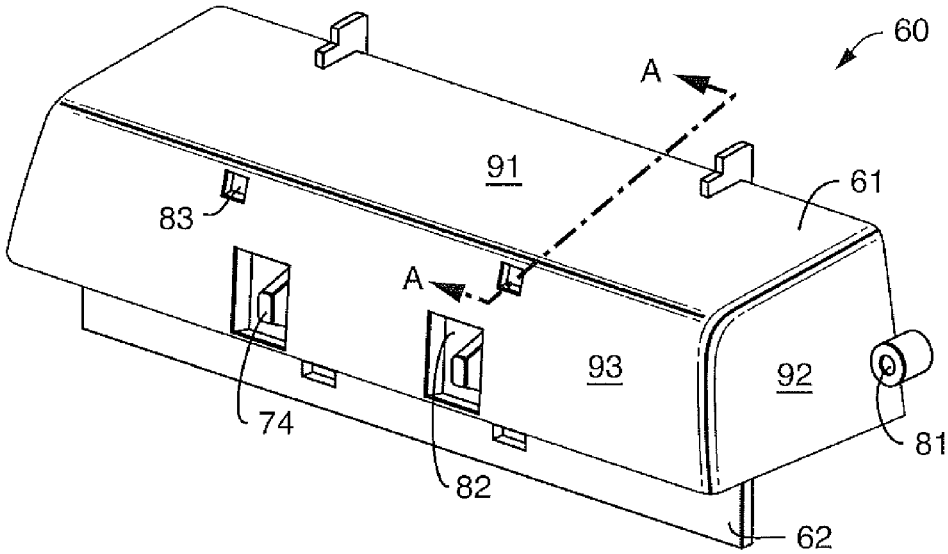
FIG. 2 shows a front perspective view of a overfill prevention device within the scope of the present invention.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

DETAILED DESCRIPTION OF THE INVENTION

Reference will now be made in detail to embodiments of the invention, examples of which are illustrated in the drawings. Each example is provided by way of explanation of the invention, and not as a limitation of the invention. For example, features illustrated or described as part of one embodiment can be used with another embodiment to yield still a further embodiment. It is intended that the present invention include these and other modifications and variations to the embodiments and examples described herein as coming within the scope and spirit of the invention.

To gain a better understanding of the present invention, attention is directed to the Figures of the present specification in general. A dispenser 10 is configured to dispense an individual sheet from a stack of folded individual sheets. The dispenser of the present invention is particularly suitable for dispensing paper towels, tissues and other similar products that are available as individual folded sheets from a stack.

It should also be appreciated that a dispenser 10 according to the invention is not limited in its overall shape, size or configuration shown in the Figures. It should be understood that these particular dispenser shown in the Figure is illustrated merely as an example of embodiments of a dispenser that may incorporate the unique features of the present invention.

As is shown in FIG. 1, the dispenser 10 includes a mounting frame 20 adapted to hold a stack of folded sheets (not shown in FIG. 1). The mounting frame 20 has a bottom portion 21 and a top portion 22, with a bottom panel 29 optionally having a dispensing opening 30 located at or near the bottom portion 21 of the mounting frame 20. The bottom panel 29 may be a separate component from the mounting frame 20 and joined to the mounting frame 20 using suitable means, such as adhesives, welding or mechanical fasteners. Alternatively, the bottom panel 29 may be formed integrally with the mounting plate 20, such that the mounting plate 20 and bottom panel 29 are one single piece. The mounting frame 20 also includes a back panel 24, and may have two side walls 27 and 28. The bottom panel 29 along with the back panel 24 and side walls 27 and 28, if present, create a storage space 26 that allows the mounting frame 20 to hold the stack of folded articles.

The mounting frame 20 is typically mounted to a support surface, such as a wall or the like, which serves to hold the dispenser 10 on the support surface. As such, the back panel 24 may be provided with various mounting means, such as pre-formed holes 25, as is shown in FIG. 1, which mechanical fasteners may be used to fasten the mounting frame to the support surface. Other suitable mounting means may also be used.

Figure 5:
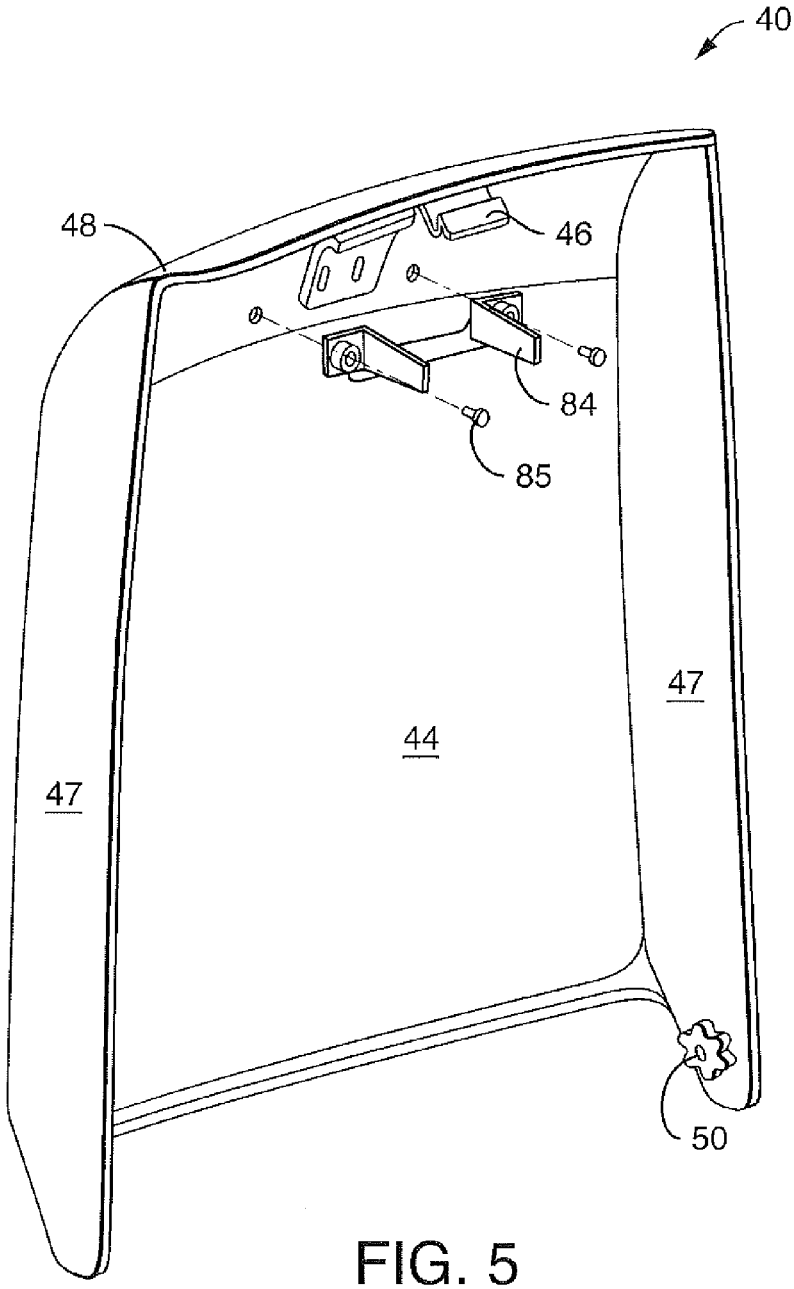
FIG. 5 shows an inside exploded perspective view of a overfill prevention device within the scope of the present invention.

Referring to both FIGS. 1 and 5, the dispenser 10 further has a cover 40 which is movably attached to the mounting frame 20. The cover may have side panels 47, a front panel and interior surface 44 and an exterior surface 42. As shown in FIGS. 1 and 5, the cover 40 may be attached to the back part of the mounting frame 20, for example to the bottom panel 29 or the side walls 27, 28, and is movable from a closed position, in which the interior storage space 26 of the dispenser, including the stack of folded sheets cannot be accessed other than through the dispensing opening 30, to an open position, where easy access is provided to the internal storage space 26 for loading additional folded sheets into the storage space. In its closed position, the cover 40 defines a front panel 48 of the dispenser 10. The cover 40 is pivotally mounted to the stationary part of the mounting frame 20 by a pivotal mounting mechanism 32 located on the mounting frame 20 with a complementary pivot mounting mechanism 50 located on the inside of the cover 20, in particular on the side panels 47 of the cover 20. As an example shown in FIGS. 1 and 5, the mounting mechanism 32 is an opening in the bottom panel 29 of the mounting frame 20 and the complementary mounting mechanism 50 on the cover is projection which is sized and shaped to fit into the opening of the mounting mechanism. It should be appreciated that any number of conventional pivotal arrangements are known and may be utilized to pivotally mount the cover 40 to the mounting frame 20 so long as the cover 40 may be easily moved out of the way to access the interior storage space 26 of the dispenser 10. In addition, the cover 40 may be releasably locked to the mounting frame 20 by any conventional locking device 46 and a complementary lock receiver 34 present on the mounting frame. It should be appreciated that the locking device may be keyed or unkeyed, and that the main purpose of the locking device is to retain the cover 40 in a closed position.

As is stated above, the dispenser 10 includes at least one dispensing opening 30. The dispensing opening 30 is how a user accesses folded sheets 12 and how the folded sheets 12 are dispensed from the internal storage space 26. In the illustrated embodiment shown in FIG. 1, the dispensing opening 30 is defined in the bottom panel 29 of the mounting frame. This is not a limitation of the invention. For example, the dispensing opening 30 could also be defined in a bottom portion or panel member of the cover 40. The dispensing opening 30 may be disposed in any convenient location for a user to pull and dispense the individual folded sheets 12 from the internal storage space 26. Typically, the dispensing opening 30 is located at or near the bottom portion of the mounting frame and will be generally be located in the bottom panel 29 of the mounting frame 20.

A dispenser 10 according to the invention includes an overfill prevention device 60. The overfill prevention device 60 is configured to be located at or near the top portion of the mounting frame 20 and serves to prevent a service technician from overfilling or stuffing the dispenser with folded sheets 12 to the point where operation of the dispenser is compromised. Generally speaking, the overfill prevention device 60 is actuated by movement of the cover 40. With the cover 40 closed, as the stack of sheets 12 is depleted, the overfill prevention device automatically moves to a position so as to reduce the internal storage space 26 within the mounting frame 20. When the cover 24 is opened for refilling the stack, the overfill prevention device 60 is engaged and the available space for refilling the stack is restricted. When the cover 40 is subsequently closed after refilling the supply of stacked sheets 12, the overfill prevention device 60 is disengaged and any compressive forces acting on the stack of sheets 12 is relieved.

Referring particularly to FIGS. 2-4, 6-8, an embodiment of the overfill prevention device 60 is shown. The overfill prevention device 60 has a bracket 62 and a locking element 72. The bracket 62 has a first section 64 which is pivotally connected to a housing 61 and an opposite second section 66. In addition, the bracket 62 has a lower portion 67 which is adapted to contact the stack of folded sheets 12 in the dispenser 10 and the upper portion 68 which is adapted to be engaged with the locking element. The bracket 62 is adapted to contact a stack of folded sheets 12 in the second section 66 along the lower portion 67 of the bracket 62, when the dispenser 10 is filled with a stack of folded sheets 12. As is stated above, the bracket 62 is pivotally connected to the housing. As a result, the second section 66 of the bracket 62 is free to rotate in an arc 65 about the pivotally connected first section 64, when the locking element 72 is not engaging the bracket 62, as will be discussed below. This rotation of the bracket 62 results in the bracket 62 having a filling position, shown in FIG. 6 and a dispensing position, shown in FIG. 8.

Figure 4:
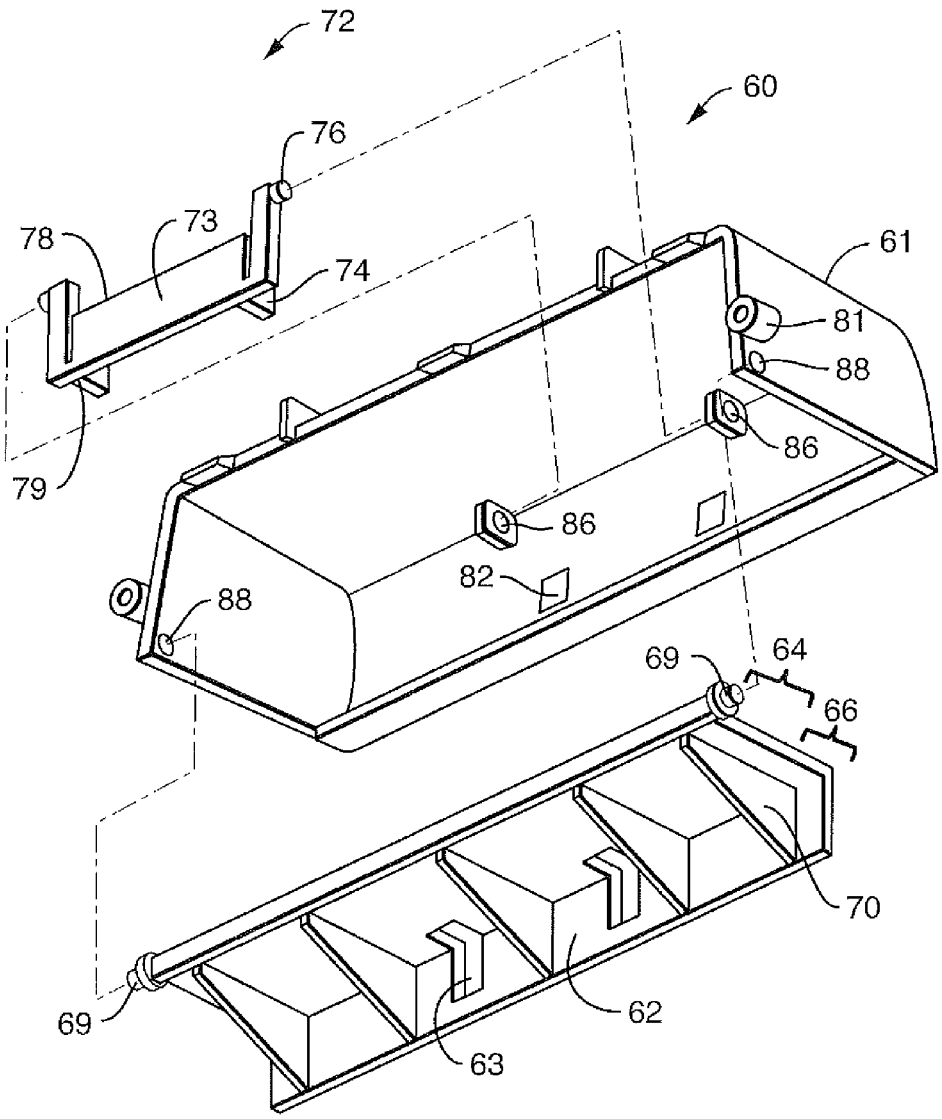
FIG. 4 shows a exploded perspective view of a overfill prevention device within the scope of the present invention.

The pivotal connection of the bracket 62 to the housing 61 may be achieved through any convention pivotal connection means. As is shown in FIG. 4, the pivot connection is an axle 69 extending from the first section 64 of the bracket 62. A complementary slot 88, which is adapted to accept the axle 69 of the bracket is located on the housing 61 such that the axle 69 will fit into the slot 88 and that the bracket 62 will rotate in an arc 65, show in FIG. 6, about the pivotal connection created by the axle I 69 and the slot 88. Other conventional pivot connection may be used, other than the one exemplified in the drawings without departing from the scope of the present invention. For example, the bracket could contain the slot and the housing could contain the axle. By having the bracket 62 pivotally connected to the housing 61, the second section 66 of the bracket 62 is free to move in an arc 65 about the pivotal connection. This will allow the bracket 62 to rotate from the position shown in FIG. 6 to the position shown in FIG. 8, when the cover 40 is closed, which is described in more detail below.

Figure 6:
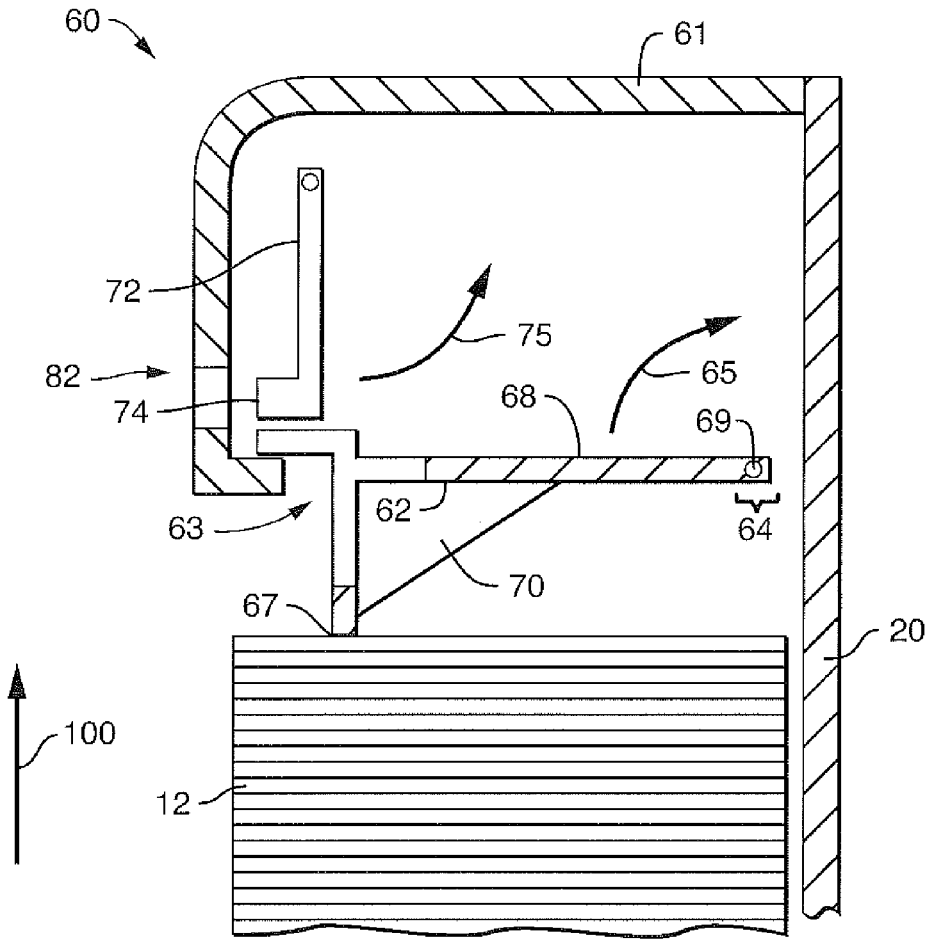
FIG. 6 shows a cross sectional view of the overfill prevention device within the scope of the present invention in the filling position.

The locking element 72 is adapted to engage the bracket 62 and serves to hold the bracket 62 in the filling position when the cover 40 of the dispenser 10 is open. In addition, the locking element 72 also releases the bracket 62 when the cover of the dispenser 40 is closed. The locking element 72 will engage the upper portion 68 of the bracket 62, as is shown in FIG. 6 and holds the bracket 62 in place, preventing the bracket 62 from being moved by the technician filling the dispenser 10. This will be described in more detail below.

Figure 7:
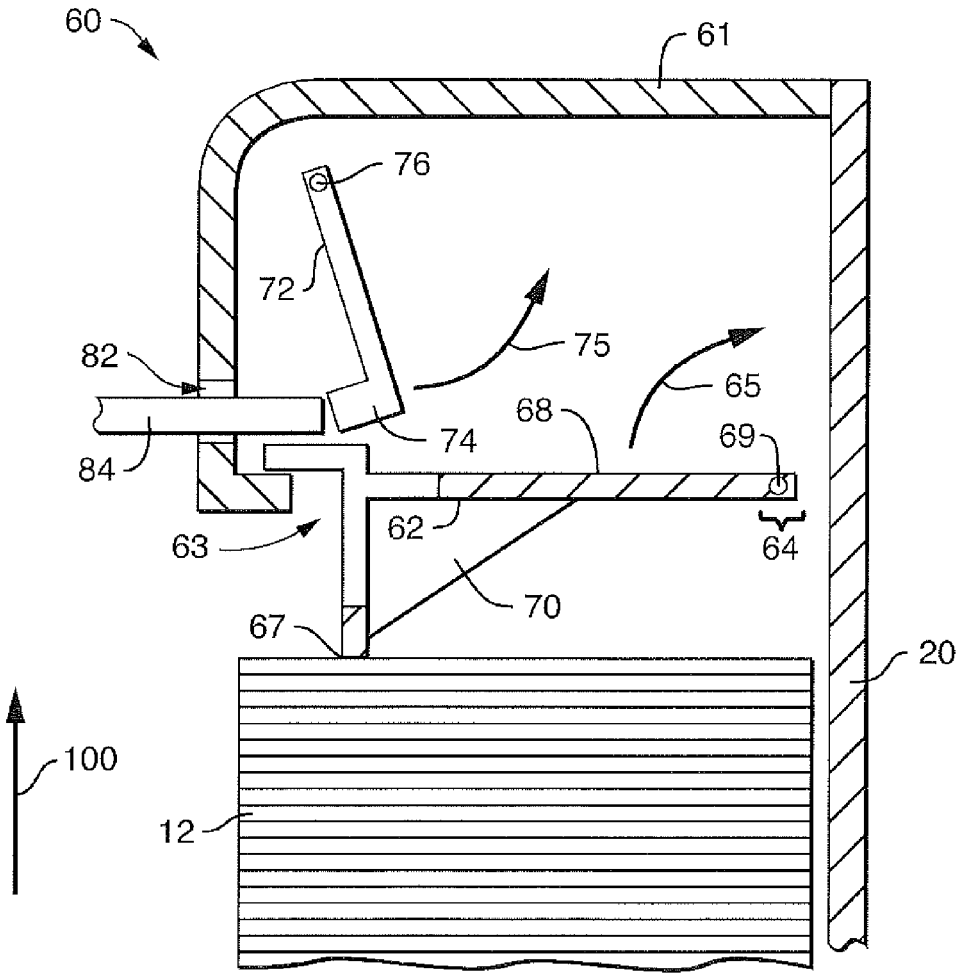
FIG. 7 shows a cross sectional view of the overfill prevention device within the scope of the present invention converting from the filling position to the dispensing position.

The locking element 72 may be a plate 73 as is shown in FIGS. 5, 6 and 7. Generally, the locking element 72 will have a first end 78 and an opposite second end 79. In addition the locking element 72 is connected to the housing 61 of the overfill prevention device 60 with a pivot connection at or near the first end 78. As is shown in FIG. 4, the pivot connection is an axle 76 extending from the first end 78 of the locking element. A complementary slot 86, which is adapted to accept the axle is located on the housing 61 such that the axle 76 will fit into the slot 86 such that the locking element 72 will rotate in an arc 75, show in FIG. 6, about the pivot connection. Other conventional pivot connections may be used, other than the one exemplified in the drawings without departing from the scope of the present invention. For example, the locking element could contain the slot and the housing could contain the axle. By having the locking element 72 pivotally connected to the housing 61, the opposite second end 79 of the locking element 72 is free to move in an arc 75 about the pivot connection. This will allow the locking element 72 to move out of the way of the bracket 62 when the cover 40 is closed so that the bracket 62 can rotate in the arc 65, which is described in more detail below.

The overfill prevention device 60 further has a housing 61. As described above, the housing 61 serves as pivotal connection points for both the bracket 62 and the locking element 72. As shown in the drawings, the housing 61 is a separate element from the mounting frame 20; however, the housing 61 could be integral with the mounting frame 20, such that the mounting frame 20 and housing 61 are a single continuous piece. When the housing 61 is a separate element, the housing will generally be provided with a mounting means 81, which will allow a mechanical fastener to attach the housing 61 to the mounting frame 20. Additionally, the housing 61 serves to protect both the bracket 62 and the locking element 72 from tampering by a technician loading a stack of folded sheets 12 into the dispenser 10 to override the overfill prevention device.

Referring to FIG. 5, the inside surface 44 of the cover 40 has at least one projection 84 extending away from the inside surface 44 of the cover 40. The projection(s) 84 on the inside surface 44 of the cover 40 are adapted to engage the locking element 72, thereby causing the locking element 72 to disengage from contact with the upper portion 68 of the bracket 62. The projections on the inside of the cover may be integral with the cover (not shown) or may be a separate elements which is held to the inside surface 44 via a suitable fastening means 85. As shown in FIG. 5, the fastening means 85 is a mechanical fastener; however other suitable fastening means, such as adhesive attachment, welding or other similar fastening means may be used. Further, the size and shape of the projections 84 are not critical to the present invention; so long as the projections 84 on the inside cover 44 will contact the locking element 72 and disengage the locking element 72 from the upper portion 68 of the bracket 62, as the cover of the dispenser is closed. The projections can be cylindrical, cuboidal or other similar shapes, for example.

The housing 61 of the overfill prevention device 60 further has at least one opening 82. The opening(s) 82 allow the projections 84 on the inside surface 44 of the cover 40 to contact and engage the locking element 72 through the housing 61. The housing will generally have a top surface 91, side surfaces 92 and a front face 93. Typically, the openings will be in the front face 93 of the housing. The front face 93 of the housing 61 is the side of the housing 61 that faces away from the mounting frame 20. Typically, the openings 82 in the housing should be positioned in the housing such that the projections 84 will line up with the openings 84, allowing the projections 84 to contact the locking element 72 as the cover 40 of the dispenser 10 is closed. The size of the opening should be such that the projections 84 easily enter through the opening 82, but not so large as to allow an adult human finger to fit through the openings 82. By keeping the openings 82 to smaller than an adult human finger, it is more difficult for a technician to use their finger to override the overfill prevention device 60. Generally, at least one dimension of the opening 82, such as the diameter or width will be less than 7 mm, more generally less than 5 mm. In addition to the opening 82, the housing 61 may further have secondary openings 83 therein to confuse a technician that is trying to override the overfill prevention device. The secondary openings 83 are generally positioned such that the locking element 72 cannot be contacted with a probe.

The locking element 72 may further optionally have one or more legs 74, extending from the second end 79 of the locking element 74. The legs 74 may serve to extend the locking element 74 into the opening 82 so that the projections will easily contact the locking element 72 as the cover 40 is closed.

The legs 74 further provide additional weight to the locking element, allowing the locking element to be positioned in the filling position.

Figure 3:
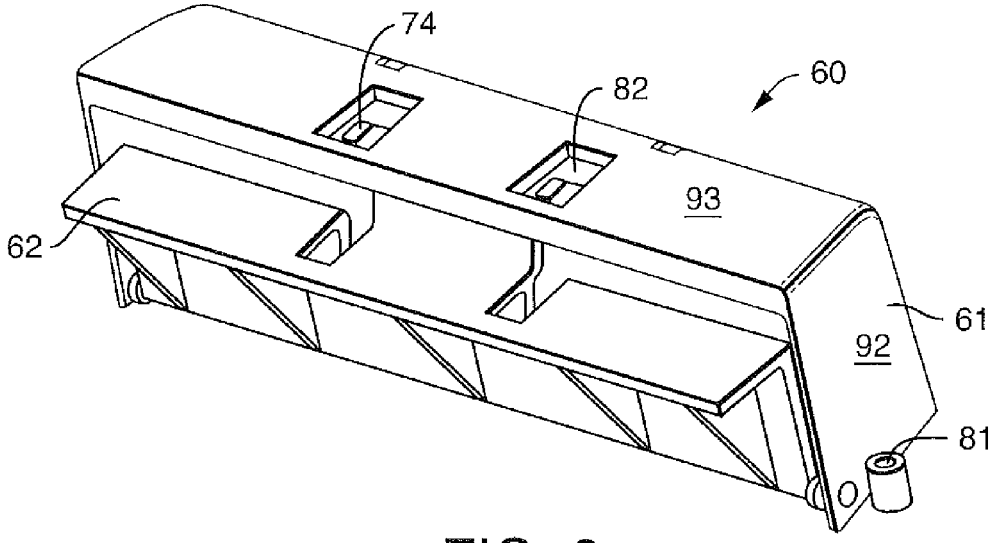
FIG. 3 shows a bottom perspective view of a overfill prevention device within the scope of the present invention.

The bracket 62 will generally have an L shape, a triangular shape or a arc shape. When an L-shape, as is shown in FIGS. 3 and 4, the bracket can have additional features such as supports 70. The supports 70 help provide structural rigidity to the bracket 62. No matter what the shape of the bracket 62, the bracket 62 may be provided with one or more slots 63 which are positioned on the bracket 62 at a location which corresponds with the openings 82 in the housing 61. The slots 63 facilitate the bracket 62 moving from the filling position, shown in FIG. 6, to the dispensing position, shown in FIG. 8. The slots 63 allow the bracket 62 to move from the filling position to the dispensing position around the projections 84 on the inside surface 44 of the cover 40 as the cover is being closed. It is noted that the slots 63 are optional, but depending on the location of the openings 82 in the housing 61, the slots could be required. That is, the lower on the front face 93 the opening 82, the more likely the slots 63 will be needed on the bracket 62.

In the present invention, there are typically at least two projections 84 located on the inner surface 44 of the cover 20, at least two complementary openings in the housing 61 and there are at least two legs 74 of the locking element. Typically, there will be two of each. Having a single projection, opening or leg could cause the overfill prevention device to not properly work if the projection was damaged. In addition, having two or more of each of these elements allows the force being applied by the projections to be more evenly distributed to the locking element.

In the overfill prevention device, the locking element 72 and the bracket 62 are positioned in the filling position, shown in FIG. 6, by the force of gravity. That is, the natural state for both the bracket 62 and the locking element are in the positions shown in FIG. 6, even when the dispenser is empty (i.e., does not contain a stack of folded sheet) or the dispenser is less than full (i.e., contains less than a full stack of folded sheets. It is noted that both the locking element 72 and the bracket 62 could be biased into the position shown in FIG. 6, by using mechanical means such as a spring, without departing from the scope of the present invention. However, given that the force of gravity is sufficient, it is preferred that no biasing mean is used.

Figure 8:
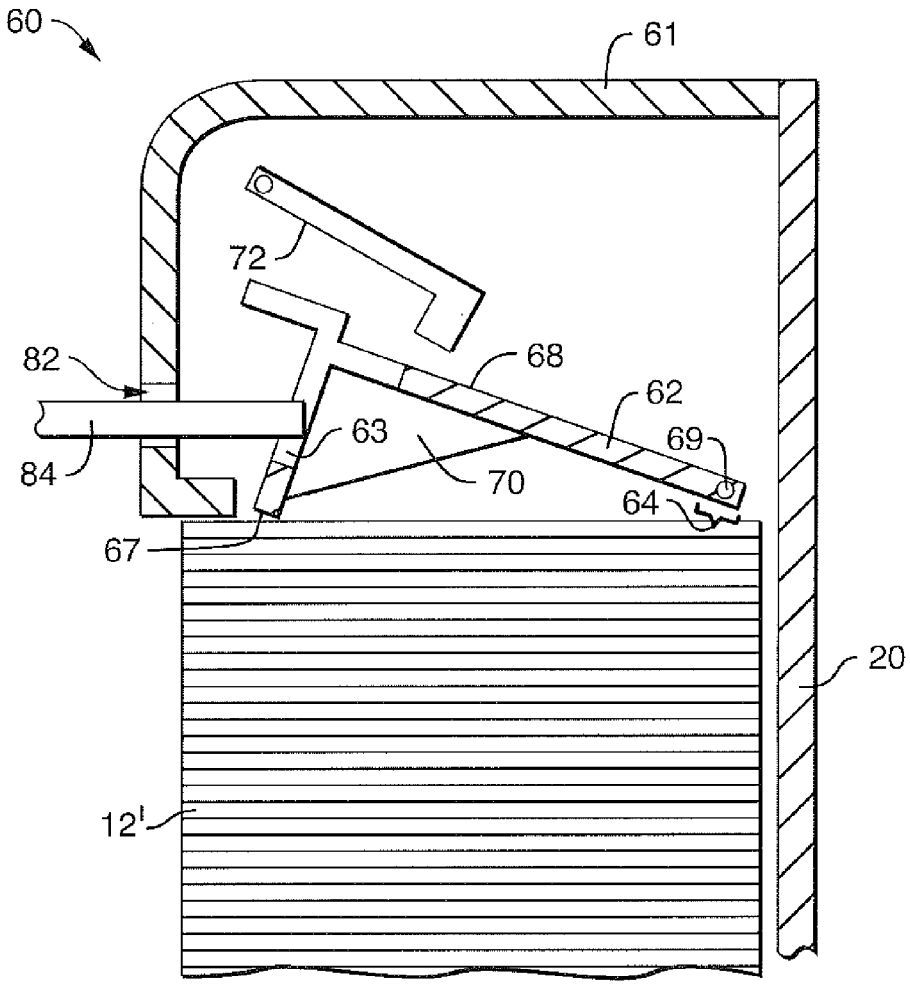
FIG. 8 shows a cross sectional view of the overfill prevention device with the scope of the present invention in the dispensing position.

To gain a better understanding of the operation of the overfill prevention device 60 of the present invention, attention is directed to FIGS. 6-8. FIG. 6 shows the overfill prevention device 60 in the filling position. In this position, gravity or another biasing force causes both the bracket 62 and the locking element 72 in the position shown in FIG. 6. In this position, the locking element 72 engages the upper portion 68 of the bracket 68. This retains the bracket in the position shown in FIG. 6, such that the lower portion 67 of the bracket 62 limits the number of folded sheets that can be in the stack 12. Generally, the technician will compress the stack 12 so that the maximum number of folded sheets can be loaded into the dispenser 10. This will result in an upward force 100 being placed on the bracket 62 due to the compression of the folded sheets. This upward force 100 will cause the upper portion 68 of the bracket 62 to apply an upward force onto the locking element 72. Since the locking element 72 is essentially perpendicular to the upper portion 68, the locking element 72 is unable to rotate out of the way of the bracket 62. Once no additional folded sheets can be added to the stack 12, the technician will generally close the cover 40.

As the technician closes the cover 40, the projections 84 on the inner surface 44 of the cover, will move through the opening 82 in the housing 61. In this regard attention is directed to FIG. 7. As the projections 84 move through the opening 82, the projection 84 will contact the locking element 72. As the cover 40 is continued to be closed by the technician, the locking element 72 is caused to move in an arc 75 about the pivot point 76. As the locking element 72 clears the upper portion 68 of the bracket 62, the bracket 62 becomes free from the locking element 72 and the force 100 exerted by the compressed stack of folded sheets 12 cause the bracket 62 to move in the arc 65 about the pivot point 69. The bracket 62 will move in the arc 65 to a position similar to that shown in FIG. 8. It is noted that the actual distance the bracket 62 will move is dependent on the force exerted by the stack of folded sheets 12. It is noted that the stack of folded sheets 12' shown in FIG. 8 is in a less compressed state that the stack shown in FIG. 6 or 7. Applicants also noted that it is not necessary for the bracket 62 to move. If the stack of folded sheets is not compressed, or is only slightly compressed before the cover 40 is closed, it is possible that the bracket could remain in the position shown in FIG. 6.

If the bracket 62 does move to the position shown in FIG. 8, as the individual sheets are removed from the dispenser and the stack becomes shorter, the bracket 62 will return to the position shown in FIG. 6. It is noted that the locking element 72 will remain in a position shown in FIG. 8 or will return to a position such that the locking element 72 will contact the projection 84, until the cover 40 is again opened. Once the cover is open, the locking element will return to the position shown in FIG. 6, provided that a sufficient number of folded sheets are removed from the dispenser. If only a few sheets have been removed, the locking element would remain in the position shown in FIG. 8.

Typically, the components of the folded sheet dispenser of the present invention as described above may be formed of any suitable material, including metal, plastic, and so forth. The construction of such dispensers is well known to those skilled in the art and need not be described in great detail herein.

The advantages of the present invention is that the overfill prevention device is a simple, low cost and effective way to prevent the technician servicing the folded sheet dispenser from overfilling the dispenser. Further, the overfill prevention device of the present invention is functional without the need for biasing elements, that can cause problems and add complexity for prior art overfill prevention devices.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

The invention claimed is:

1. A folded sheet dispenser comprising a. a mounting frame adapted to hold a stack of folded sheets, the mounting frame including a back panel, a bottom portion and a top portion;

b. a cover connected to the mounting frame, the cover having an inside surface which faces the mounting frame and an exterior surface forming the front of the dispenser, the cover having at least one projection extending from the inside surface;

c. a dispensing opening located at or near the bottom portion of the mounting frame;

d. an overfill prevention device located at or near the top portion of the mounting frame, said overfill prevention device comprises 1) a bracket having a first section which is pivotally connected to a housing and an opposite second section, said second section being free to rotate in an arc about the pivotally connected first section, the bracket has a filling position and a dispensing position, wherein the bracket is adapted to contact a stack of folded sheets when the dispenser is filled with a stack of folded sheets;

2) a locking element which engages the bracket and holds the bracket in the filling position when the cover of the dispenser is open and releases the bracket when the cover of the dispenser is closed, the locking element further comprises at least one plate, each plate having a first end and an opposite second end, each plate connected to the mounting frame with a pivot connection at or near the first end and the opposite second end of each plate is free to move in an arc about the pivot connection, the second end of the plate engages the bracket thereby retaining the bracket in the filling position when the cover is open; and wherein the projection on the cover engages the locking element as the cover is being closed such that the locking element releases the bracket to allow the bracket to move to the dispensing position.

2. The dispenser according to claim 1, wherein the bracket moves into the filling position by the force of gravity and the locking element engages the bracket by the force of gravity.

3. The dispenser according to claim 1, wherein at least one plate engages the bracket using the force of gravity.

4. The dispenser according to claim 1, wherein the bracket comprises an upper portion and a lower portion, wherein the lower portion is adapted to contact the stack of folded sheets in the dispenser and the upper portion is adapted to be engaged with the locking element.

5. The dispenser according to claim 4, wherein the upper portion of the bracket further comprises at least one slot, said slot being positioned at or near where the locking element engages the bracket, wherein the slot is configured to allow the protrusion on the cover to engage the lock element without engaging the bracket.

6. The dispenser according to claim 1, wherein the overfill prevention device further comprises a housing, and the housing comprises at least one opening, such that the opening is positioned to allow the projection on the cover to contact the locking element.

7. The dispenser according to claim 6, wherein the cover comprises two or more protrusions and the mounting frame comprise two or more openings.

8. The dispenser according to claim 7, wherein the cover has two protrusions and the housing has two opening that correspond to the two protrusions.

9. The dispenser according to claim 8 wherein the housing has additional openings at or near the openings for the protrusion.

10. The dispenser according to claim 9, wherein the openings have a width or diameter which is less than 7 mm.

11. The dispenser according to claim 1, wherein the bracket comprises an upper portion and a lower portion, wherein the lower portion is adapted to contact the stack of folded sheets in the dispenser and the upper portion is adapted to be engaged with the locking element.

12. The dispenser according to claim 11, wherein the upper portion of the bracket further comprises at least one slot, said slot being positioned at or near where the locking element engages the bracket, wherein the slot is configured to allow the protrusion on the cover to engage the lock element without engaging the bracket.

13. The dispenser according to claim 12, wherein the overfill prevention device further comprises a housing, and the housing comprises at least one opening, such that the opening is positioned to allow the projection on the cover to contact the locking element.

14. The dispenser according to claim 1, wherein the locking member comprises a plurality of plates.

15. The dispenser according to claim 14, wherein the second end of at least one plate engages the bracket, retaining the bracket in the filling position when the cover is open.

16. A folded sheet dispenser comprising a. a mounting frame adapted to hold a stack of folded sheets, the mounting frame including a back panel, a bottom portion and a top portion;

b. a cover connected to the mounting frame, the cover having an inside surface which faces the mounting frame and an exterior surface forming the front of the dispenser, the cover having at least one projection extending from the inside surface;

c. a dispensing opening located at or near the bottom portion of the mounting frame;

d. an overfill prevention device located at or near the top portion of the mounting frame, said overfill prevention device comprises 1) a bracket having a first section which is pivotally connected to a housing and an opposite second section, said second section being free to rotate in an arc about the pivotally connected first section, the bracket has filling position and a dispensing position, wherein the bracket is adapted to contact a stack of folded sheets, when the dispenser is filled with a stack of folded sheets;

2) a locking element which engages the bracket and holds the bracket in the filling position when the cover of the dispenser is open and releases the bracket when the cover of the dispenser is closed; and wherein the projection on the cover engages the locking element as the cover is being closed such that the locking element releases the bracket to allow the bracket move to the dispensing position, wherein the bracket further comprises an upper portion and a lower portion, wherein the lower portion is adapted to contact the stack of folded sheets and the upper portion is adapted to be engaged with the locking element, the upper portion also comprises at least one slot positioned at or near where the locking element engages the bracket so that the slot is configured to allow the protrusion on the cover to engage the lock element without engaging the bracket.

* * * * *